United States Patent [19]

Cronen, Sr.

[11] 4,035,111

[45] July 12, 1977

[54] TOROIDAL ROTARY ENGINE

[76] Inventor: Peter J. Cronen, Sr., 16816 Gray's Blvd., Wayzata, Minn. 55391

[21] Appl. No.: 602,289

[22] Filed: Aug. 6, 1975

[51] Int. Cl.[2] ..... F01C 1/00

[52] U.S. Cl. ..... 418/38; 123/8.47; 418/35

[58] Field of Search ..... 418/35, 37, 38; 123/8.47

[56] References Cited

U.S. PATENT DOCUMENTS

| | | | |
|---|---|---|---|
| 1,695,888 | 12/1928 | Dowdey | 418/38 X |
| 1,879,422 | 9/1932 | Nash | 418/38 X |
| 1,950,228 | 3/1934 | Dediev | 418/38 X |
| 3,645,239 | 2/1972 | Cena | 123/8.47 X |
| 3,670,705 | 6/1972 | Saito | 123/8.47 |
| 3,854,457 | 12/1974 | Taurozzi | 418/38 X |

FOREIGN PATENT DOCUMENTS

| | | | |
|---|---|---|---|
| 267,565 | 9/1927 | United Kingdom | 123/8.47 |

*Primary Examiner*—Carlton R. Croyle
*Assistant Examiner*—Leonard Smith

[57] ABSTRACT

A rotary engine having a toroidal chamber which is stationary, and in which the pistons convey power to a common crankshaft under the control of a four-bar linkage including novel means for preventing reverse motion of any piston in the chamber. Inlet and exhaust valves to control the flow of energizing fluid are provided, and are actuated directly from the crankshaft. Novel sub-components include the four-bar linkage, the valving mechanism, and the arrangement by which rotary movement of the pistons in the chamber is eliminated.

2 Claims, 29 Drawing Figures

3
5

50
80
81
197
196
57
184
203
201
200
202
63
62
72
65
66
64
73
67
51
53
51
183
68
60
61
54
52
55
56
70
71
3
5

FIG. 3
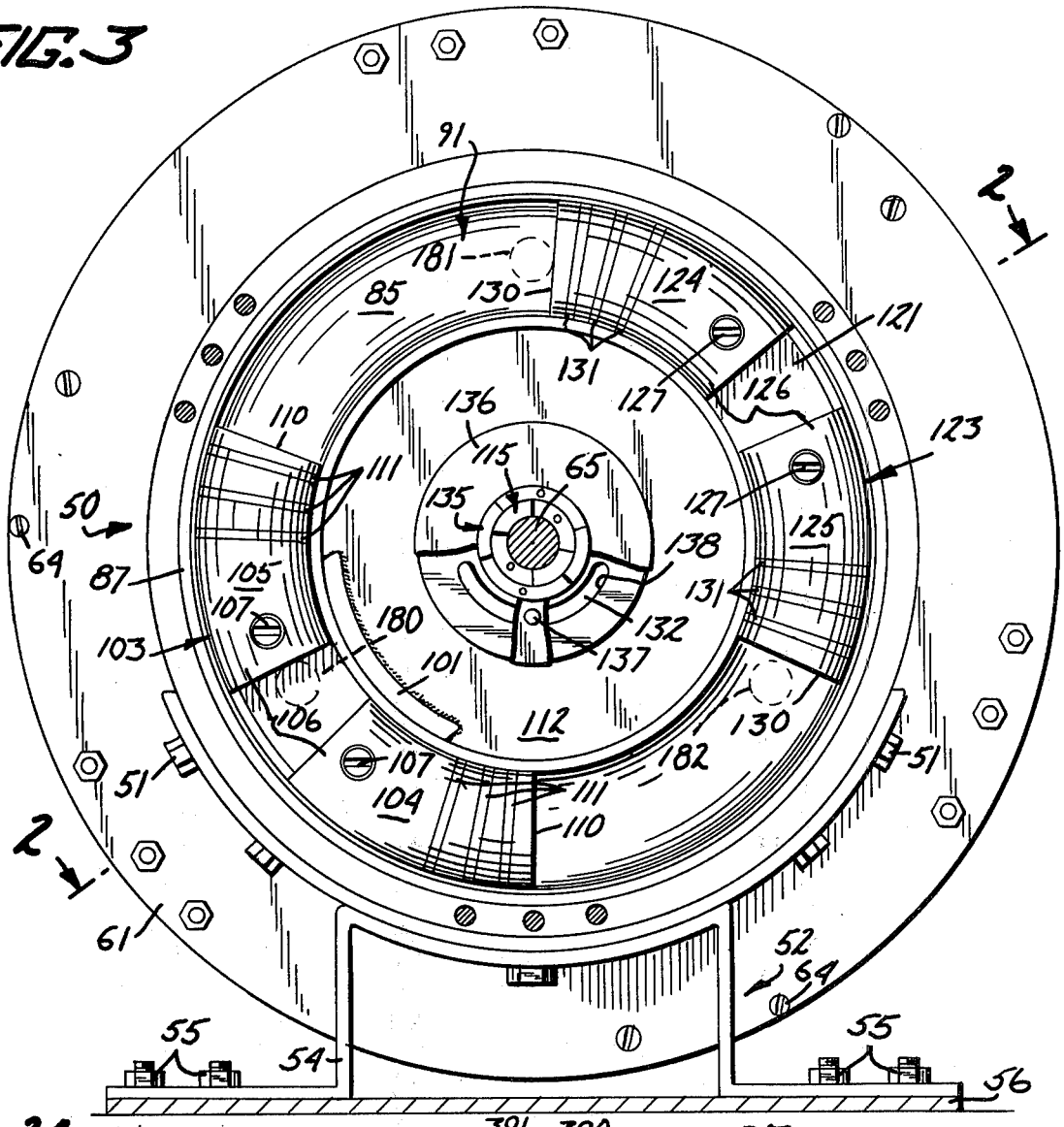
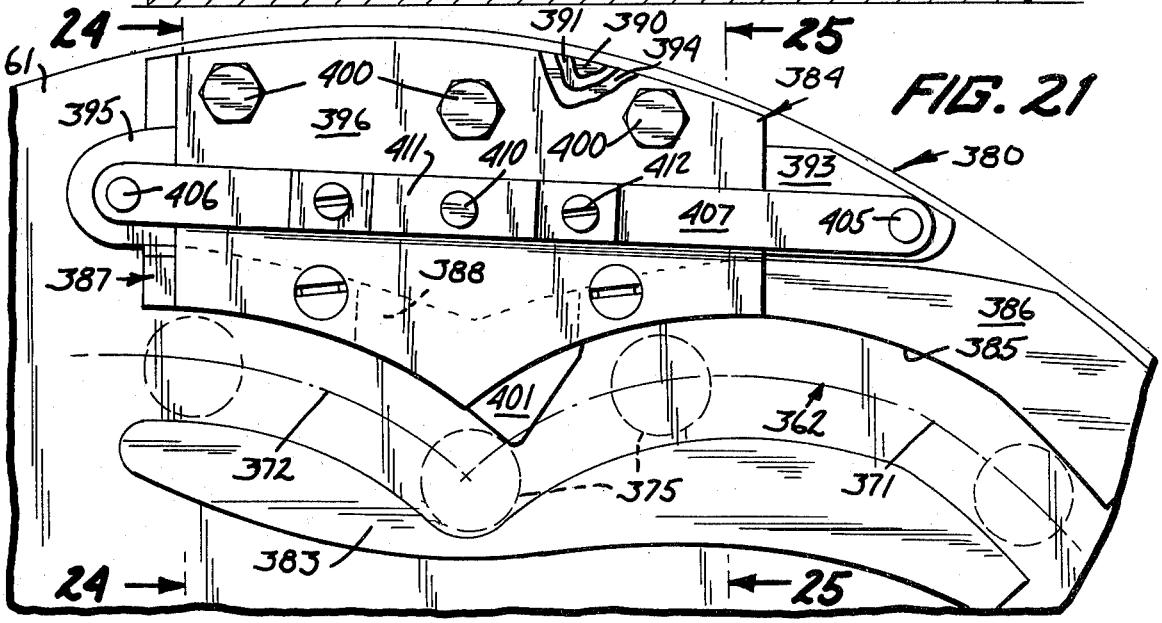
FIG. 21

FIG. 15
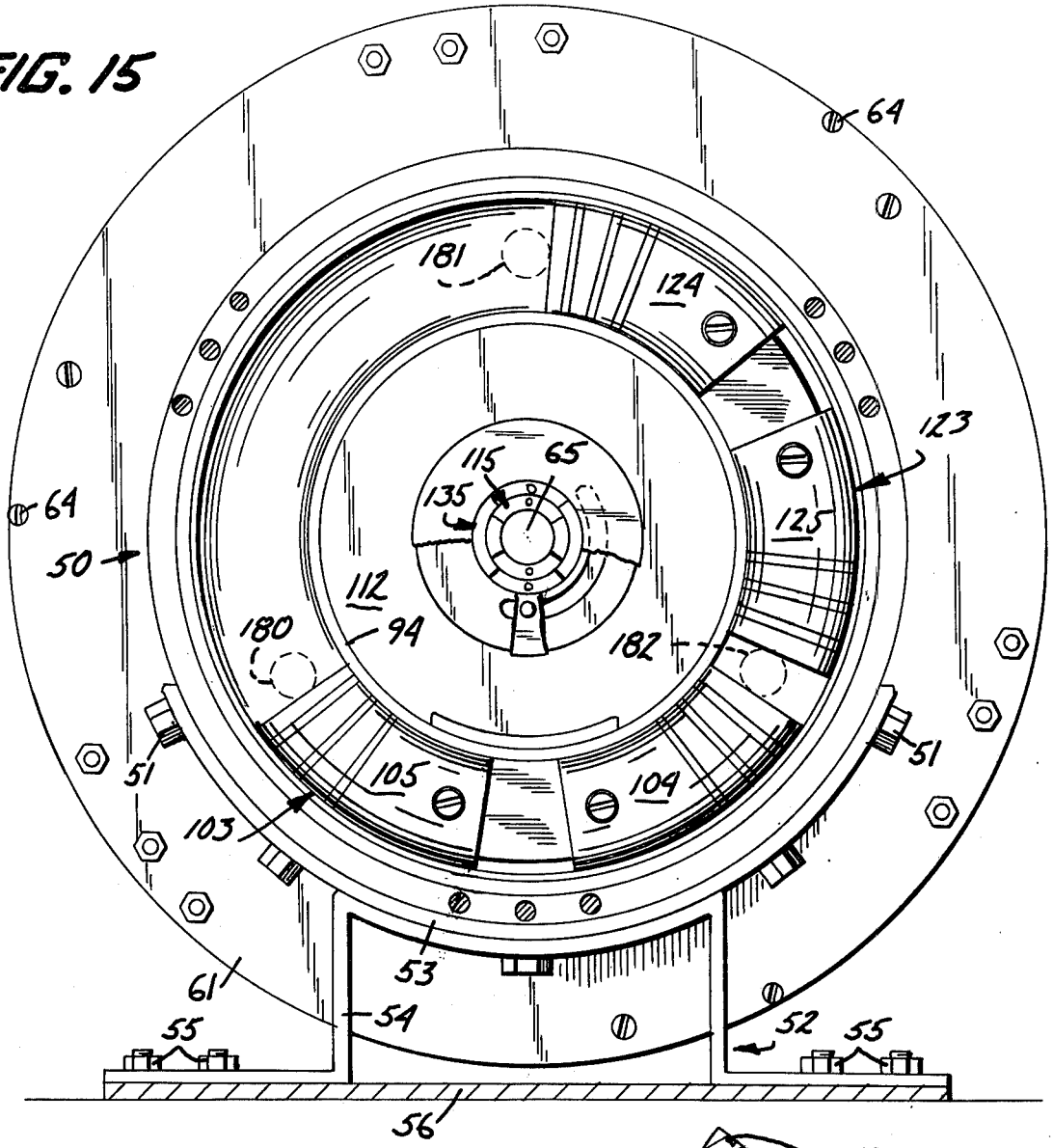
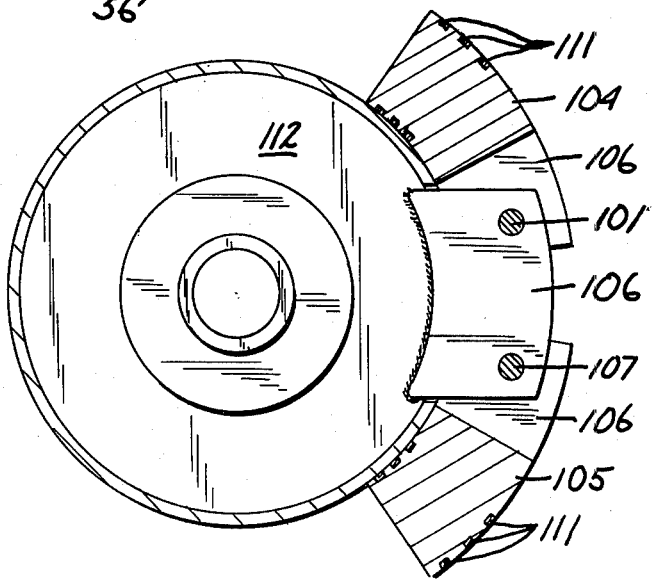
FIG. 3A

FIG. 5
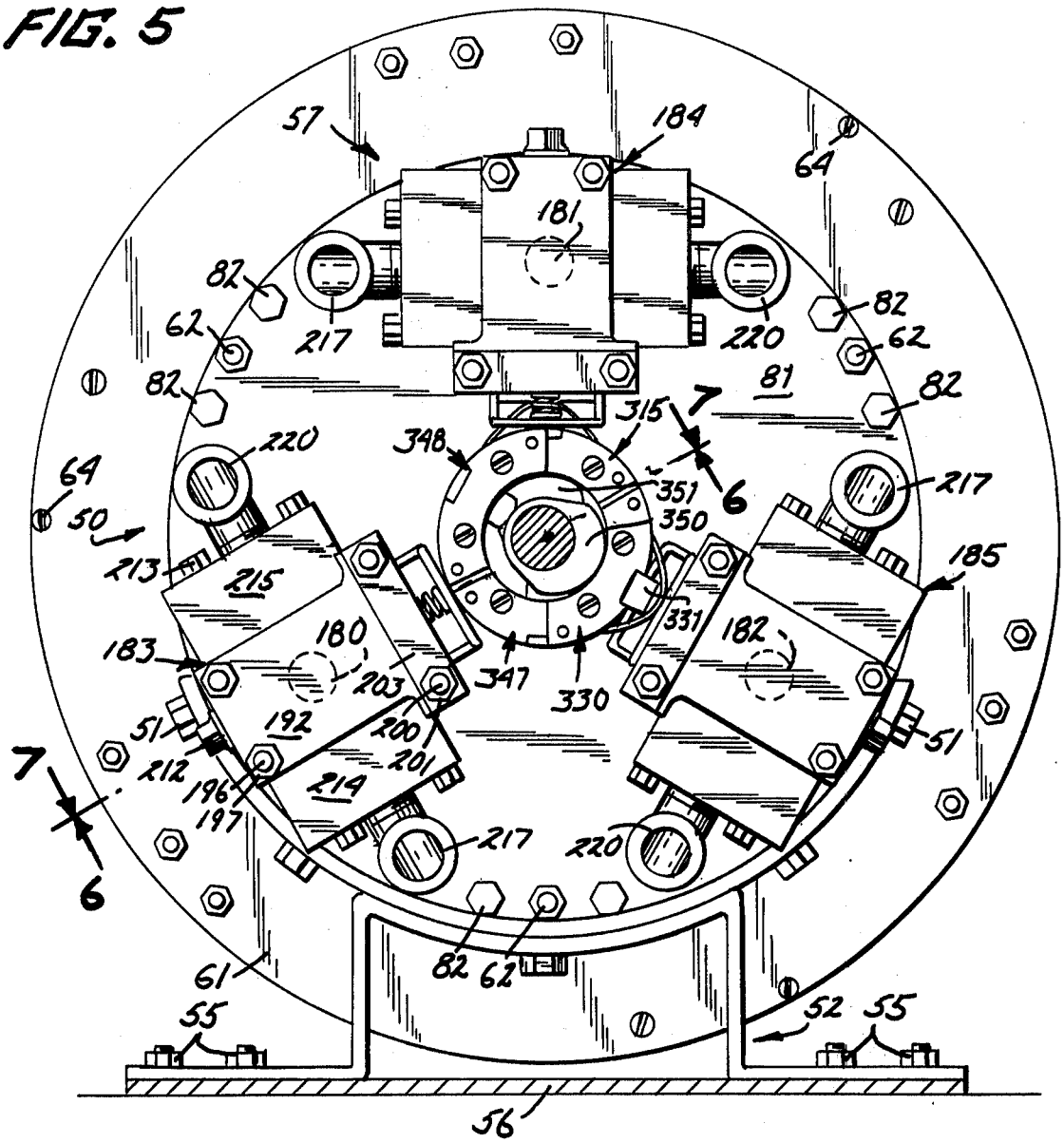
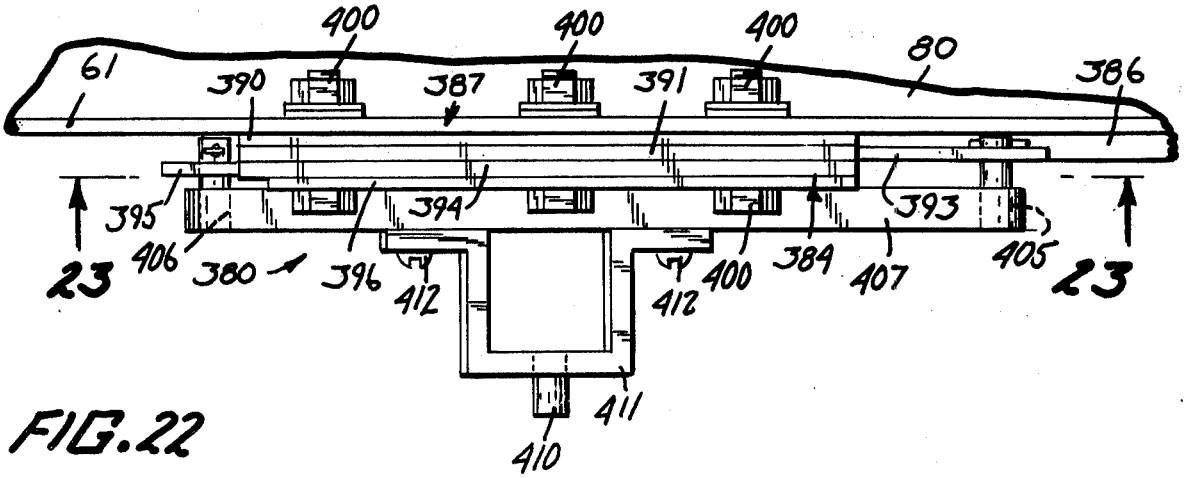
FIG. 22

FIG. 8
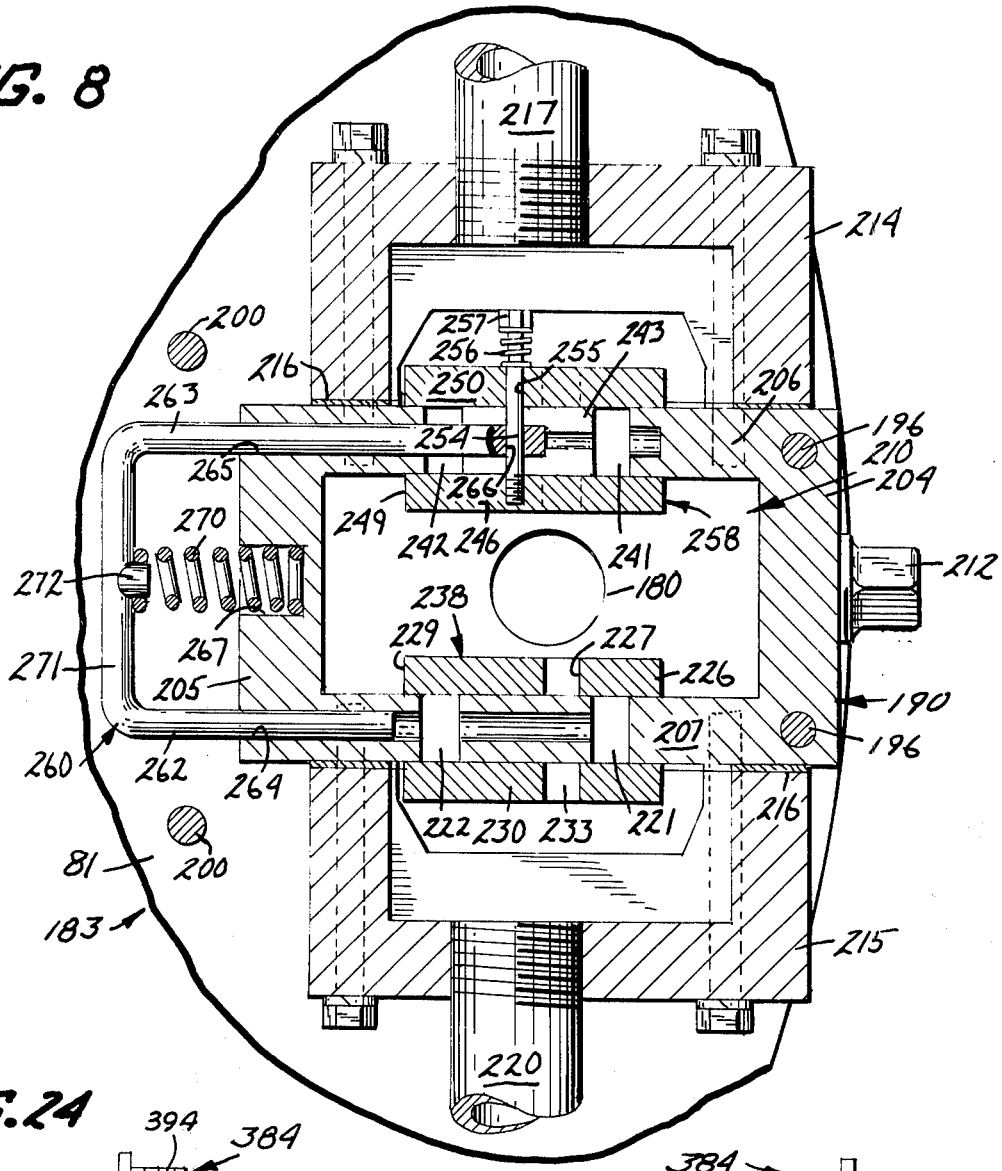
FIG. 24
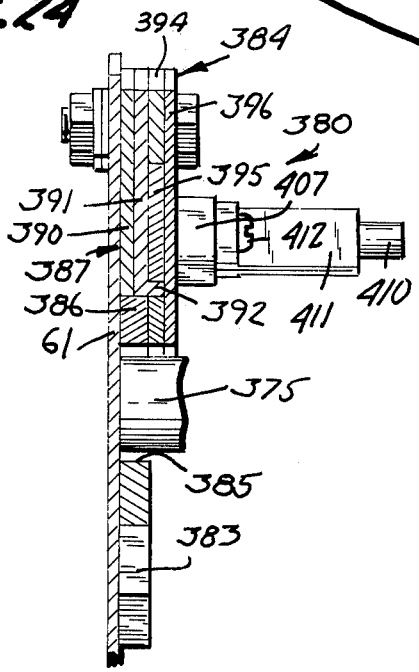
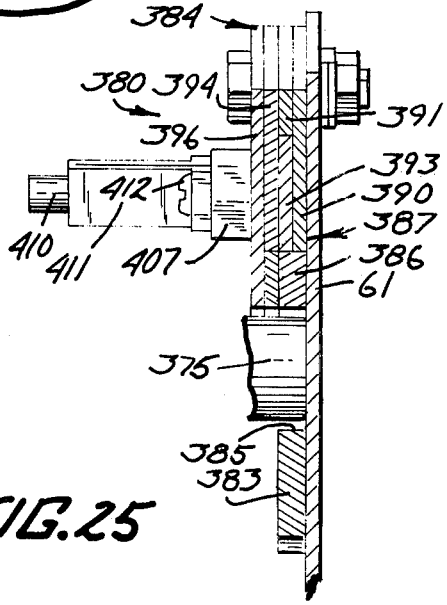
FIG. 25

FIG. 10
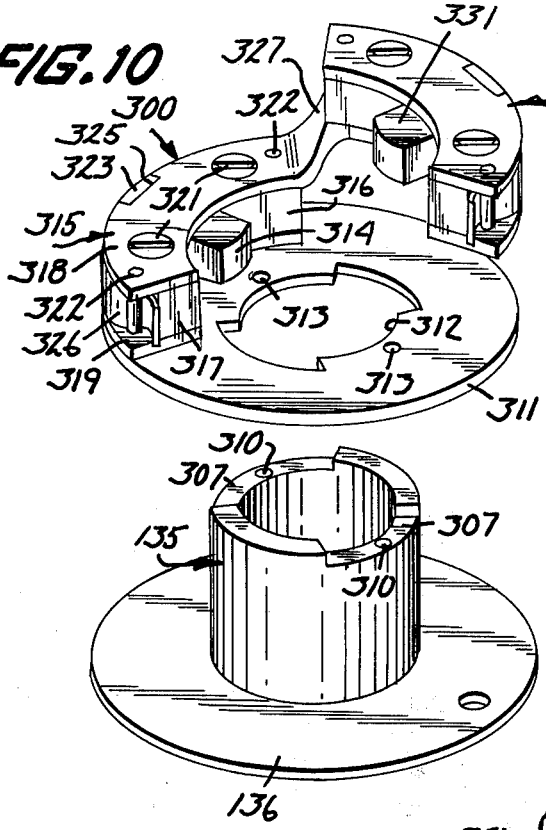
FIG. 11
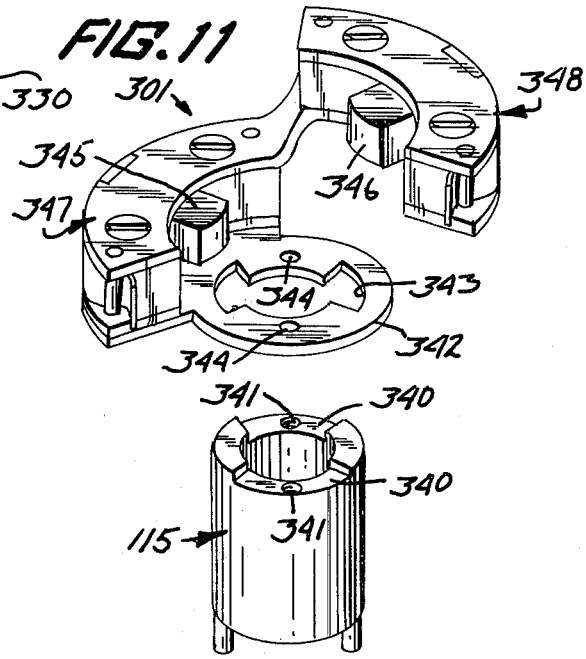
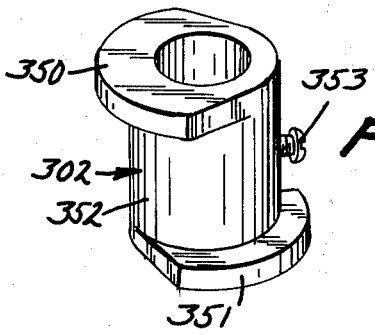
FIG. 12
FIG. 13
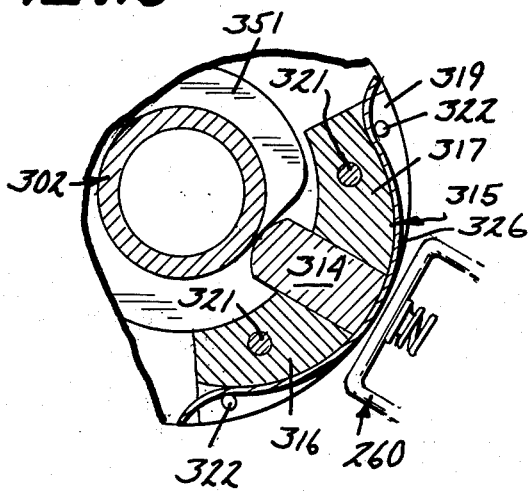
FIG. 14
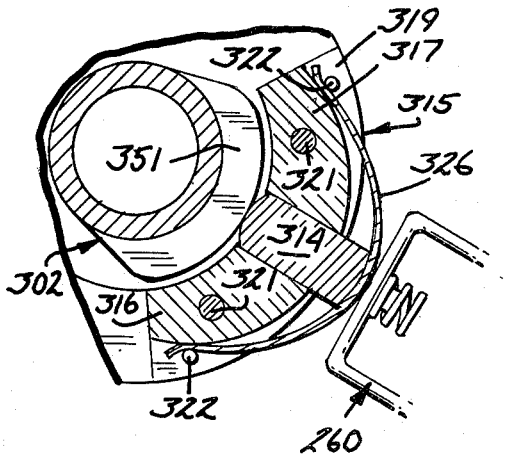

FIG. 18
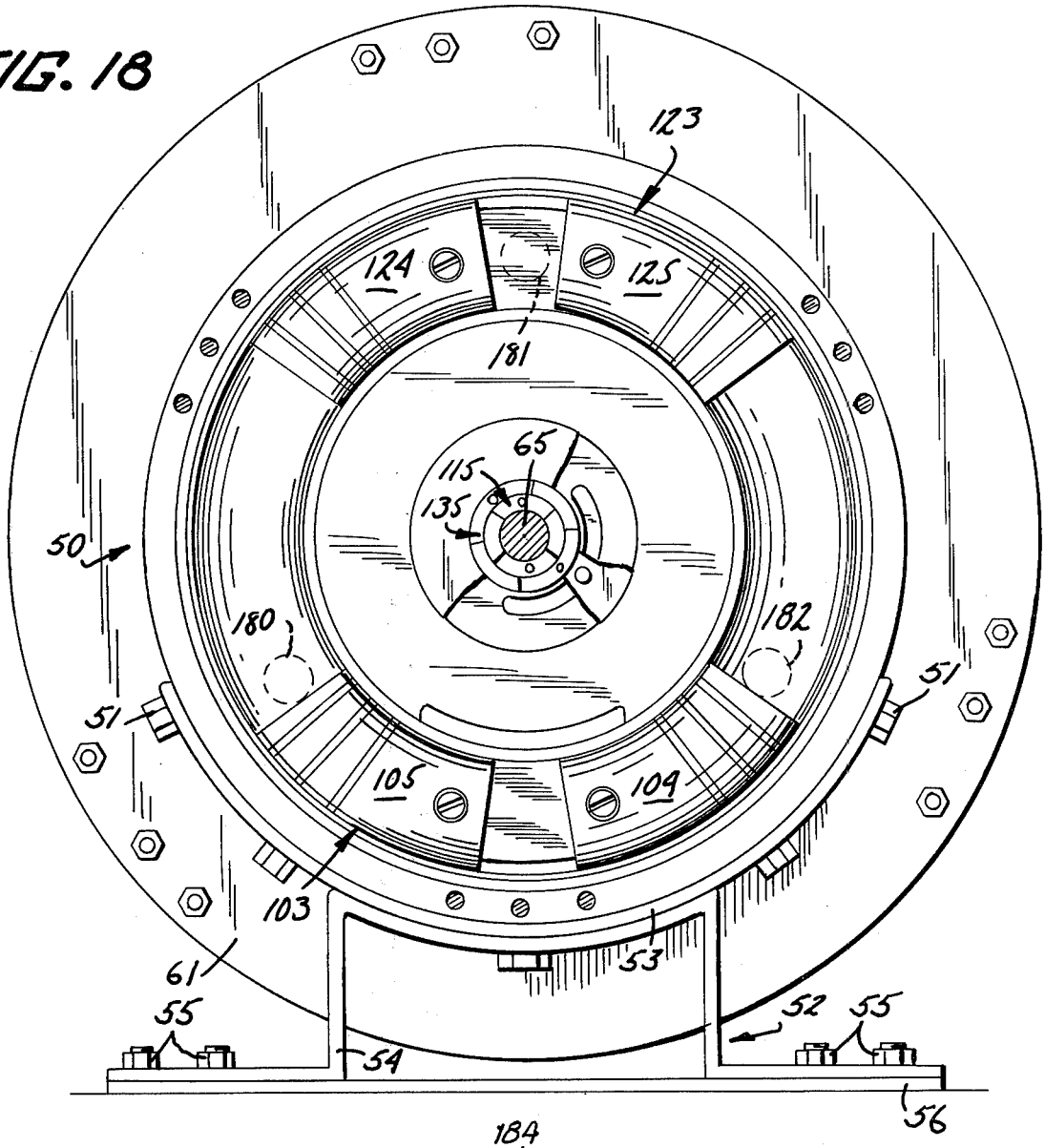
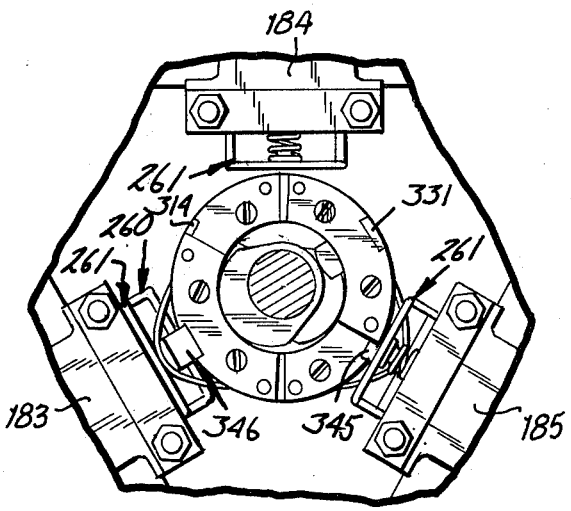
FIG. 20

TOROIDAL ROTARY ENGINE

BACKGROUND OF THE INVENTION

This invention relates to the field of mechanical power generation, and specifically is directed to an engine for converting the energy of an expanding gas to mechanical rotation. My engine can be powered by steam or compressed air or, with minor changes and with the addition of a vaporizing arrangement and an ignition system, it can be used as an internal combustion engine.

A particular advantage of my engine is that the motions therein are of continuous rotation in a single direction: no major reciprocating parts, such as the pistons of a conventional engine, are present. Again, I have devised an engine having a toroidal chamber which, nevertheless, does not have to be mounted for rotation, but can be fixed in position like the block of any conventional engine.

In accomplishing the design of an engine having these desirable characteristics, I have also devised a new mechanical motion of the four-bar linkage type, an arrangement for valving a toroidal chamber so as to cause continuous movement of pistons therein, an arrangement for preventing reverse movement of any piston in the chamber, and a method of construction by which the chamber of a toroidal engine is freed from the necessity of revolving, and can be fixed in position.

Various advantages and features of novelty which characterize my invention are pointed out with particularity in the claims axis hereto and forming a part hereof. However, for a better understanding of the invention, its advantages, and objects attained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, bidirectional

FIG. 3 is a view in transverse section taken generally along the line 3—3 of FIG. 1, portions thereof being shown in full;

FIG. 3A (sheet 9) is a fragmentary view in section of a portion of FIG. 3;

FIG. 5 is a view in transverse section taken generally along the line 5—5 of FIG. 1;

FIG. 8 (sheet 7) is a fragmentary sectional view along the line 8—8 of FIG. 7;

FIG. 10 is an exploded isometric showing of a first cam follower mechanism;

FIG. 11 is an exploded isometric showing of a second cam follower mechanism;

FIG. 12 is an isometric showing of a valving cam;

FIG. 13 is a fragmentary sectional view showing valve actuation in a first state;

FIG. 14 is a fragmentary sectional view showing valve actuation in a second state;

FIG. 15 is a view like FIG. 3 in a second condition of the motor;

FIG. 18 is a view like FIG. 4 in a third condition of the motor;

FIG. 20 (sheet 11) is a fragmentary detail like FIG. 5 in the third condition of the motor;

FIG. 21 (sheet 3) is a detail of FIG. 4 to a view in larger scale;

FIG. 2 (sheet 5) is a view in plan view of the structure of FIG. 21;

FIG. 24 (sheet 7) is a section taken along the line 24—24 of FIG. 21;

FIG. 25 is a section taken along the line 25—25 of FIG. 21;

DESCRIPTION OF THE PREFERRED EMBODIMENT

Figure 1:
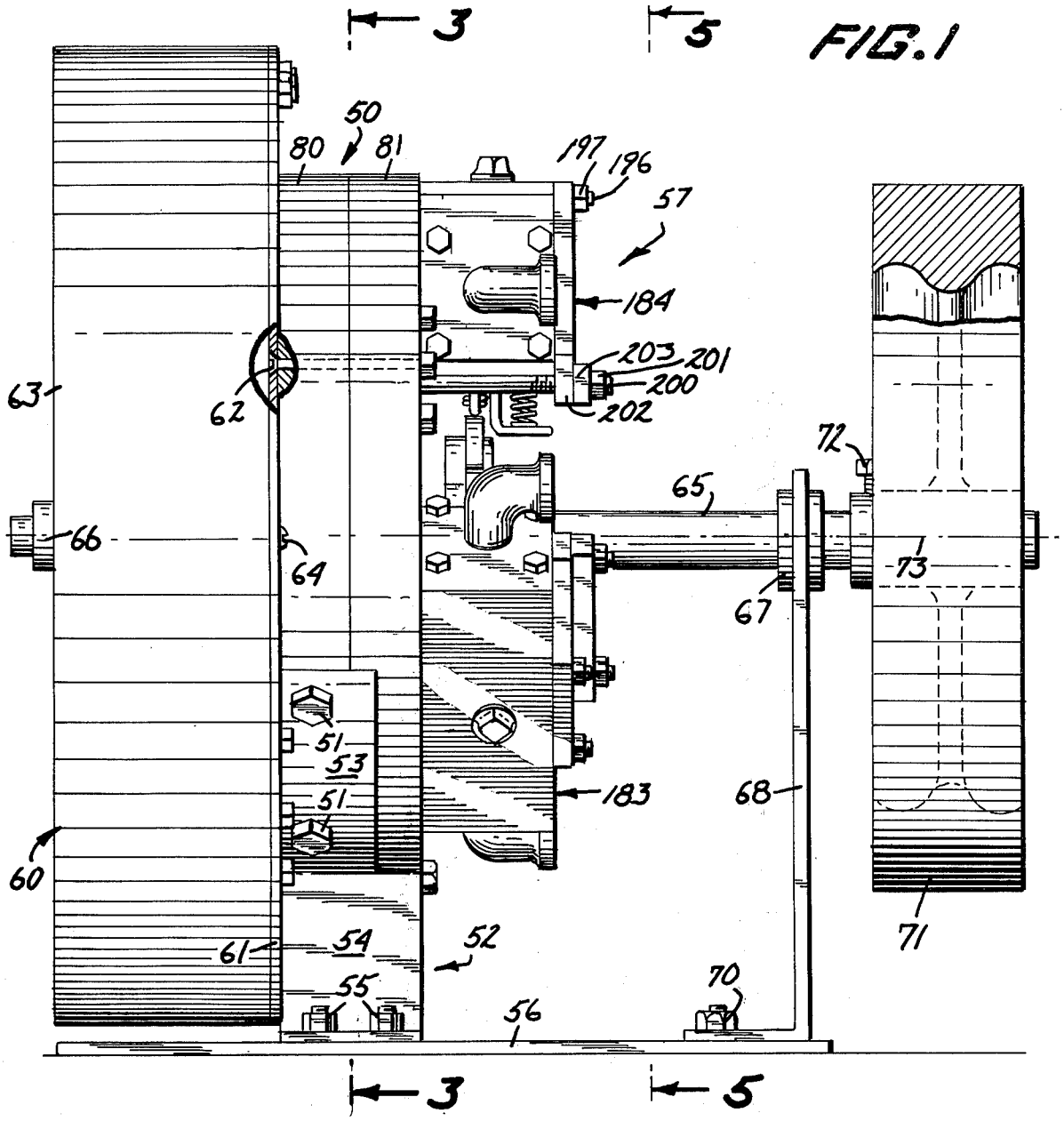
FIG. 1 is a side elevation of my motor with portions shown in section.

As shown in the drawings, my engine comprises a cylinder bloc 50 which, for convenience, I have shown as secured by fasteners 51 to a bracket 52 composed of a cradle 53 welded or otherwise fastened to a saddle 54: bracket 52 is mounted by fasteners 55 on a base plate 56. Block 50 has the configuration of a horizontal cylinder of much greater diameter than length. On one end of block 50 is mounted a valving system having the general reference numeral 57. The other end of block 50 carries a linkage chamber 60 including a mounting plate 61 secured to the block by fasteners 62, and a cover 63 secured to the mounting plate by fasteners 64.

A crank shaft 65 projects from block 50 in both directions. One end of the crank shaft 65 is carried in a first outboard bearing 66 in cover 63. The other end of crank shaft 65 supplies the power output of the engine. I have shown it as carried in a second outboard bearing 67 supported by a bracket 68 mounted on base plate 56 by fasteners 70. A flywheel and drive pulley 71 is secured to crank shaft 65 by a set screw 72. The axis 73 of the crank shaft coincides with the axis of block 50, and also comprises an axis of radial symmetry presently to be referred to.

Figures 2, 2A:
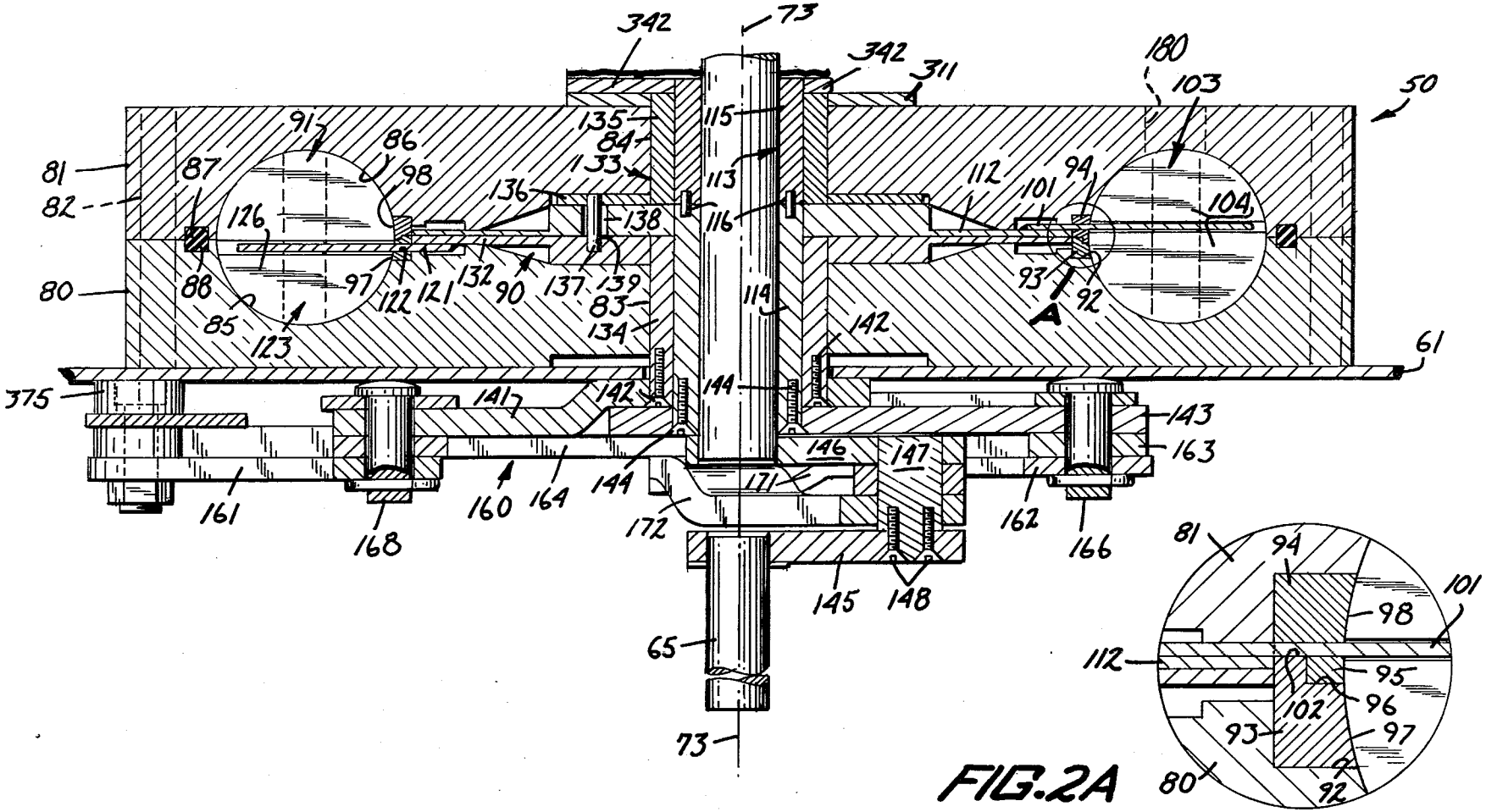
FIG. 2 is a view in transverse section taken generally along the line 2—2 of FIGS. 3 and 4, portions thereof being omitted.
FIG. 2A is an enlarged showing of the portion of FIG. 2 indicated thereon by the circled A.

The construction of cylinder block 50 and the pistons and other elements contained therein will be best understood by referring further to FIGS. 2 and 3. Block 50 is shown to comprise a first casting or fixed member 80 and a second casting or fixed member 81, secured together by fasteners 82 and provided with coaxial central bores 83 and 84, respectively. Casting 80 is provided with an annular concavity 85, and casting 81 is provided with a matching annular concavity 86. The castings touch each other only outwardly of the concavities, and a gasket or O-ring 87 may be provided in suitable grooves 88 in the faces of the castings to perfect the seal between them. Centrally of the annular concavity, the castings are hollowed out to jointly provide an annular chamber 90 of irregular outline extending through to the central bores.

Concavities 85 and 86 cooperate to define a toroidal chamber 91 having a central axis which closes on itself and is circular about an axis of radial symmetry which coincides with the axis 73. The chamber has a cross-sectional area, in any plane containing axis 73, which is almost completely circular, but has a gap at 92. This gap is filled by a pair of annular movable members 93 and 94 which are free to rotate about axis 73 with respect to each other and to fixed members 80 and 81. An annular lip 95 (FIG. 2A) projects axially from member 94 and is received in an annular rabbet 96 in member 93. These members have annular surfaces 97 and 98 which complete the circular cross-section of the toroidal chamber.

A plate 101 extends through a slot 102 in member 94 to comprise the link in a first double-ended piston assembly 103 made up of two pistons 104 and 105 having skirts 106 pivotally secured to plate 101 by piston pins 107. Plate 101 rotates with member 94 about axis 73. Each of the pistons is configured as a toroidal frustum to slide axially in chamber 91, has a head 110, and is grooved to accept piston rings 111 for ensuring a smooth running fit of the piston in the chamber while preventing appreciable leakage of gas past the piston heads. Inwardly of member 94, plate 101 is secured as by welding to a disc 112 at its thinned periphery.

Disc 112 comprises a part of a first spool assembly 113 also including sleeves 114 and 115 axially connected by dowels 116 to extend through block 50.

In like fashion, a plate 121 extends through a slot 122 in member 93 to comprise the link in a second double-ended piston assembly 123 made up of two pistons 124 and 125 having skirts 126 pivotally secured to plate 121 by piston pins 127. Plate 121 rotates with member 93 about axis 73. Each piston is configured as a toroidal frustum to slide axially in chamber 91, has a head 130, and is grooved to accept piston rings 131 for ensuring a smooth running fit of the piston in the chamber, while preventing appreciable leakage of gas past the piston heads. Inwardly of member 93, plate 121 is secured as by welding to a disc 132 at its thinned periphery.

Disc 132 comprises part of a second spool assembly 133 including sleeves 134 and 135, the latter carrying a further disc 136. Discs 132 and 136 are connected for unitary rotation about axis 73 by a pin 137 which is fixed in the disc 136 and passes through an arcuate slot 138 in disc 112 into a hole 139 in disc 132, thus enabling limited relative rotation between the two spool assemblies. There is thus provided a coaxial structure, spool assembly 133 rotating in castings 80 and 81, spool assembly 113 rotating in spool assembly 133, and crank shaft 65 rotating in spool assembly 123.

The outer end of sleeve 134 is non-circular and extends outside casting 80 and mounting plate 61: a first pivot arm 141 is secured thereto by screws 142. The outer end of sleeve 114 extends beyond arm 141 and is non-circular, and a second pivot arm 143 is secured thereto by screws 144. Crank shaft 65 includes a pair of crank arms 145 and 146 joined by a crank pin 147. The crank shaft is separable at the joint between arm 145 and pin 147, the pin end being squared and shouldered so that arm 145 may be fixed thereto in non-rotary fashion by screws 148.

Figure 4:
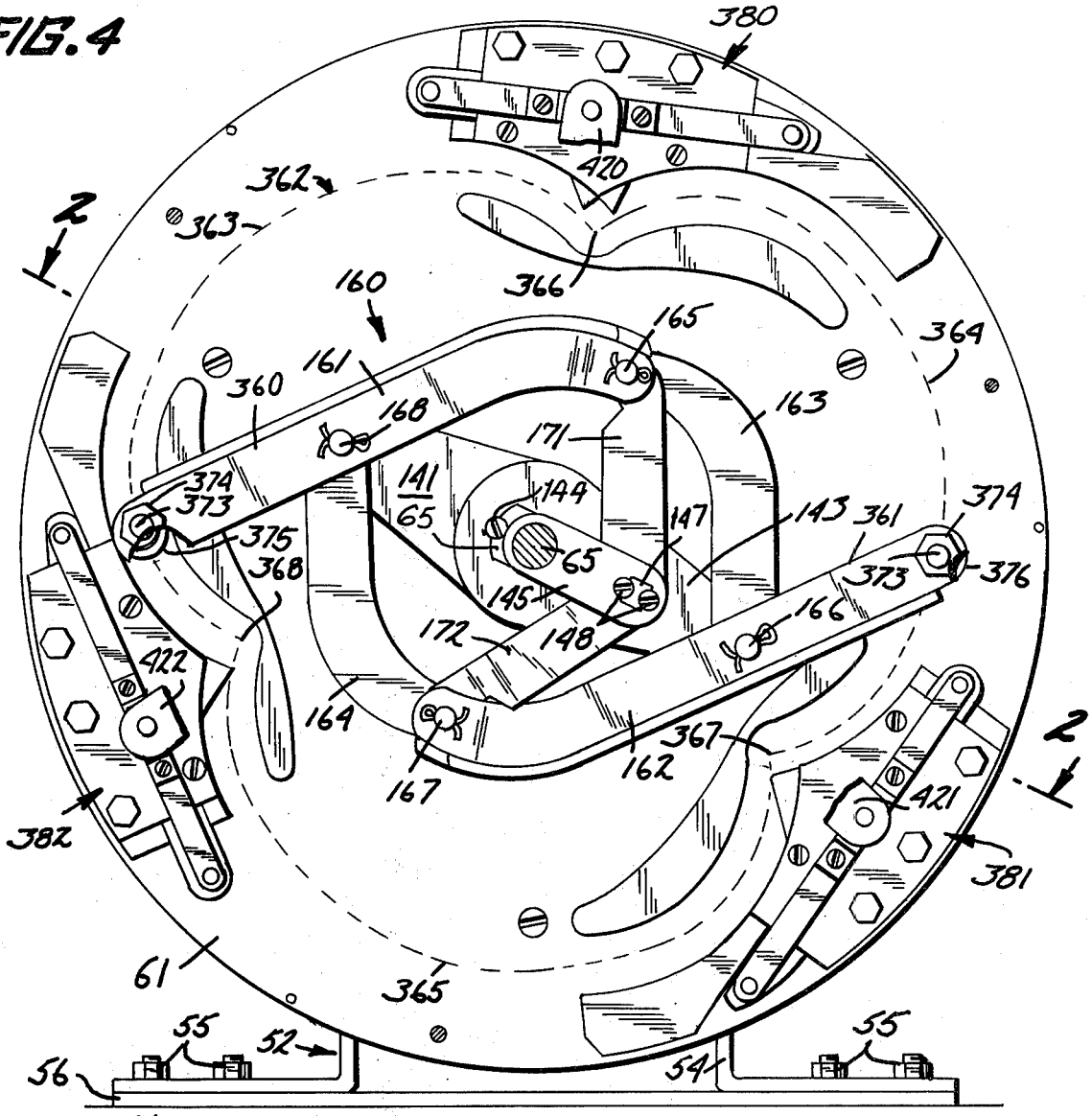
FIG. 4 is an elevational view as seen from left to right of FIG. 1 with portions thereof removed or omitted for clarity of illustration (for a complete showing, see FIG. 26)
Figure 23:
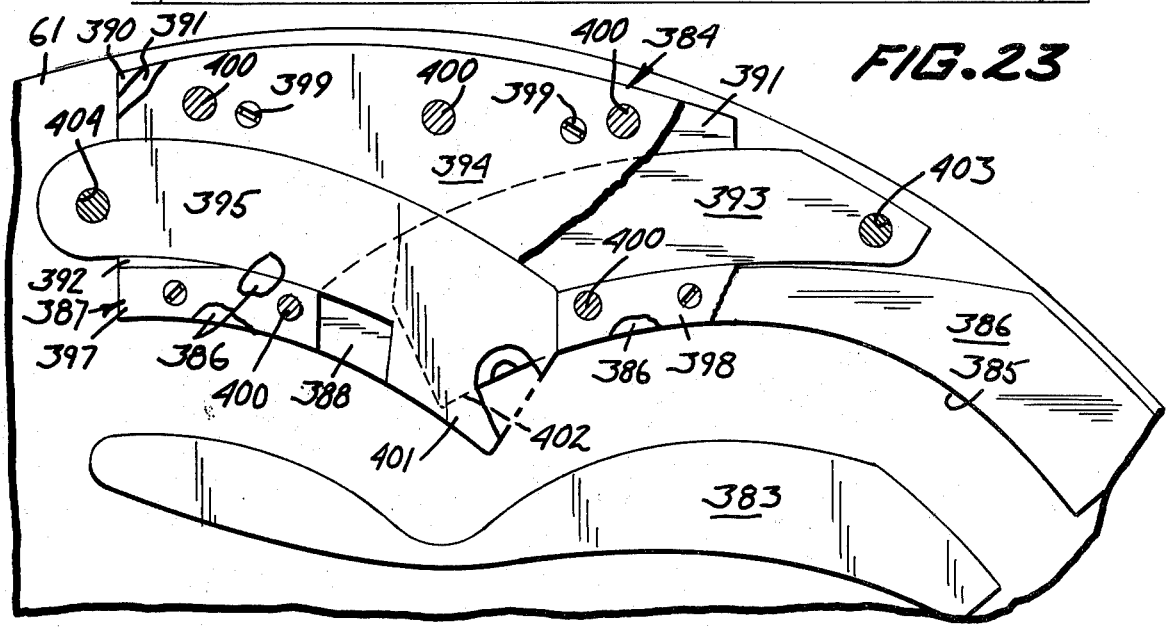
FIG. 23 (sheet 4) is a section taken along line 23—23 of FIG. 22.
Figure 6:
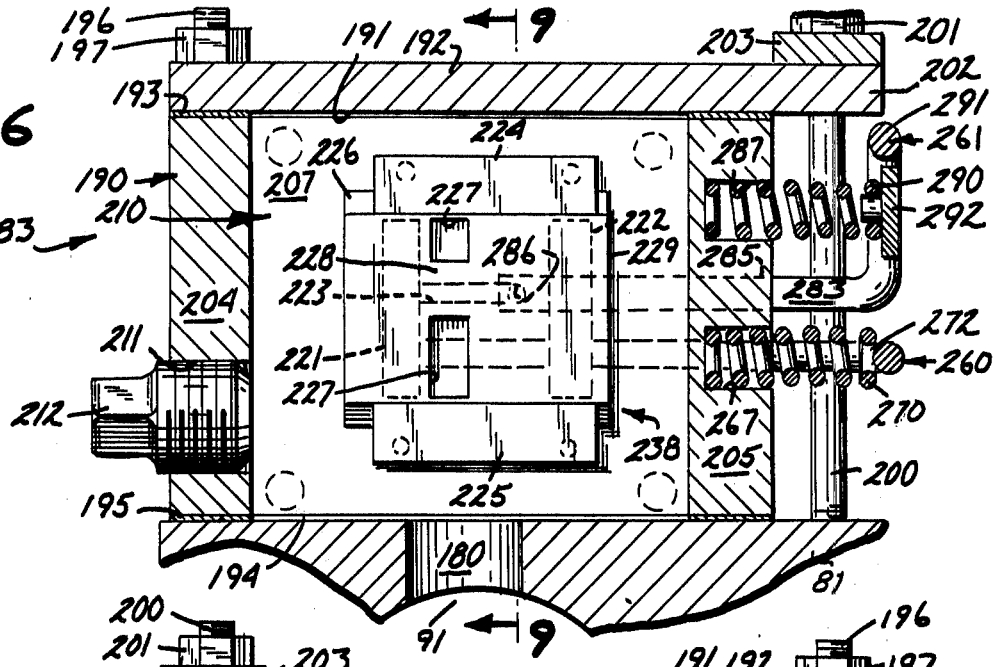
FIG. 6 is a fragmentary sectional view taken along the line 6—6 of FIG. 5.
Figure 7:
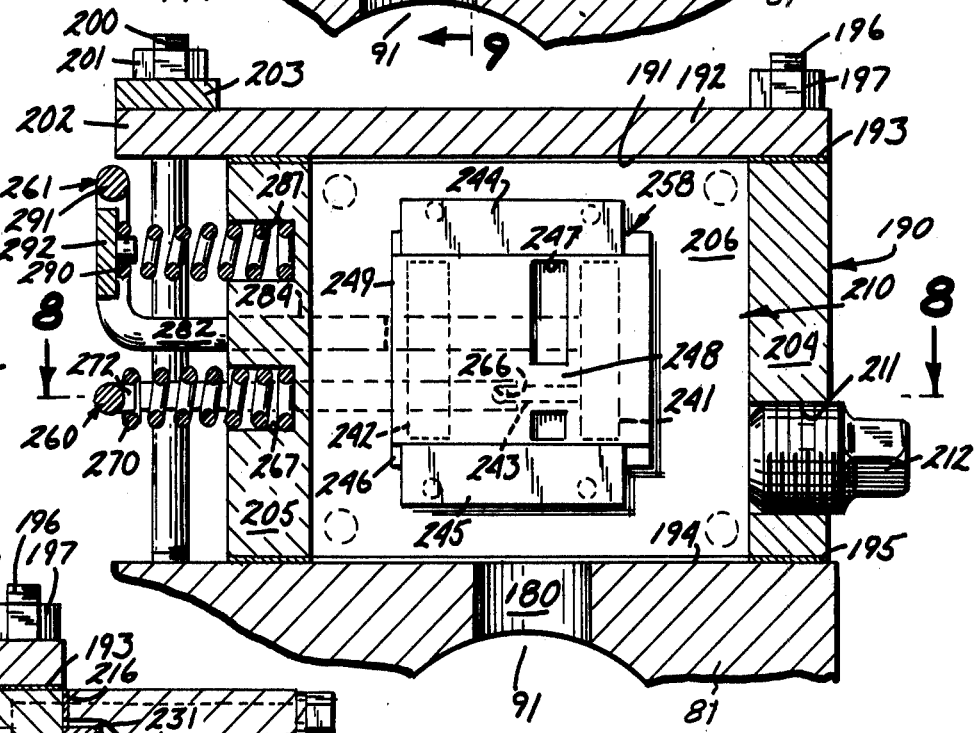
FIG. 7 is a fragmentary sectional view taken along the line 7—7 of FIG. 5.
Figure 9:
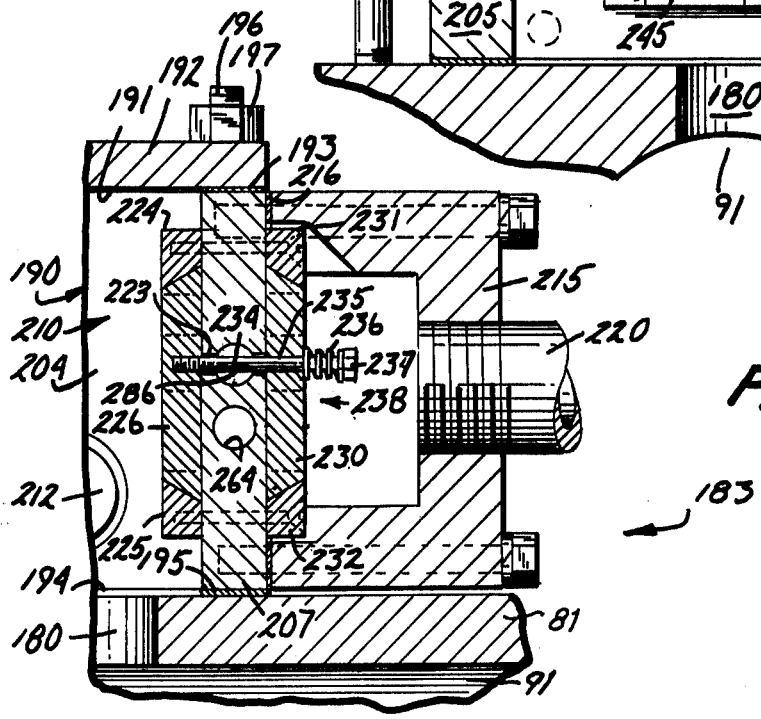
FIG. 9 (sheet 6) is a fragmentary sectional view taken along the line 9—9 of FIG. 6.

As shown in FIG. 4, chamber 60 contains a four-bar linkage 160 made up of a first pair of bars 161 and 162 and a second pair of bars 163 and 164, the bars being pivotally connected at pins 165, 166, 167 and 168. Pin 168 connects bars 161 and 164 to pivot arm 141, pin 165 connects bars 161 and 163, pin 167 connects bars 162 and 164, and pin 166 connects bars 162 and 163 to pivot arm 143. A pair of further links 171 and 172 connect pivot pins 165 and 167 pivotally to crank pin 147.

My engine is arranged for the energizing gas to cause alternate arcuate motion of the piston assemblies in a selected direction around axis 73 within chamber 91. For this purpose, casting 81 is apertured axially at three locations to give access to the chamber from the outer face of the casting. The locations of these apertures are indicated at 180, 181 and 182 in FIG. 5, and aperture 180 appears in FIG. 2.

Valving system 57 is mounted on casting 81, and includes a plurality of valving mechanisms mounted in alignment with the apertures just identified. These mechanisms are indicated by reference numerals 183, 184 and 185. Since they are identical in structure, only one description will be given.

As shown in FIGS. 1 and 5–9, mechanism 183 comprises a tubular body 190 of rectangular section open at both ends. One end 191 of body 190 is closed by a cover 192 and gasket 193. The other end 194 of the body is closed by a gasket 195 and casting 81. Cover, body and casting are secured together by studs 196 and nuts 197, and by studs 200 and nuts 201. The former studs pass through the wall of body 190 while the latter studs pass through holes in an overhanging lip 202 of cover 192 and remain outside of body 190. For added rigidity, a reinforcing bar 203 may overlie lip 202.

Body 190 has two short walls 204 and 205 and two long walls 206 and 207 surrounding a central chamber 210. Wall 204 has a tapped bore 211. When my engine operates on steam or compressed air, bore 211 is closed by a plug 212. When the engine is operated on combustible fuel, an ignition device such as a spark plug may replace plug 212.

To the outside of the long walls are secured cup-shaped members 214 and 215 of rectangular cross-section: gaskets 216 are provided between these members and member 190. The concavities of members 214, and 215 comprise inlet and outlet plenums for the valving mechanism, and are provided with pipe elbows 217 and 220 for connection to inlet and exhaust manifolds. The direction in which the engine runs is determined by which of the elbows is connected to the source of energizing gas.

Wall 207 is pierced by a pair of parallel rectangular slots 221 and 222, and by a further slot 223 extending at right angles to the first two. On its inner surface, wall 207 carries a pair of dove-tail ways 224 and 225, and a valving plate 226 moves laterally in these ways in sliding contact with wall 207. Plate 226 has a rectangular slot 227, interrupted at 228 to avoid weakening the plate unduly, passing through it, and has two positions in ways 224 and 225. In the open position of plate 226, slot 227 is in line with slot 221 in wall 207, and an edge 229 of the plate completely uncovers slot 222, while in the closed position of plate 226, unpierced portions of plate 226 occlude both of slots 221 and 222. A similar valve plate 230 contacts the outside of wall 207, guided in dove-tail ways 231 and 232, and has a similar interrupted slot 233. Plate 230 is connected to plate 226 by means including a stud 234 screwed into plate 226 and passing through slot 223 and a hole 235 in plate 230, a spring 236, and a nut 237. Members 221–237, inclusive, make up a first slide valve 238.

In a generally identical structure, wall 206 is pierced by a pair of parallel rectangular slots 241 and 242, and by a further slot 243 extending at right angles to the first two. On its inner surface, wall 206 carries a pair of dove-tail ways 244 and 245, and a valving plate 246 moves laterally in these ways in sliding contact with wall 206. Plate 246 has a rectangular slot 247, interrupted at 248 to avoid weakening the plate, passing through it, and has two positions in ways 244 and 245. In the open postion of plate 246, slot 247 is in line with slot 241 in wall 206, and an edge 249 of the plate completely uncovers slot 242, while in the closed position of plate 246, unpierced portions of the plate occlude both of slots 241 and 242. A similar valving plate 250 contacts the outside of wall 206, guided in similar dovetail ways, and has a similar interrupted slot. Plate 250 is connected to plate 246 by means including a stud 254 screwed into plate 246 and passing through slot 243 and a hole 255 in plate 250, a spring 256 and a nut 257. Members 241–257, inclusive, make up a second slide valve 258.

Separate actuating means are provided for valves 238 and 258, in the form of generally U-shaped rod members 260 and 261. Member 260 has one short leg 262 and one long leg 263. These legs slide in holes 264 and 265 in body 190, the former hole being drilled in wall 207 and the latter in wall 206. A hole 266 is formed in the inner end of leg 263, through which stud 254 passes. Wall 205 is outwardly recessed to provide a socket 267 for a compression spring 270 which acts outwardly on the central loop 271 of member 261 at a suitable pad 272. Spring 270 thus holds valve 258 in its closed position normally, stud 254 being held against one end of slot 243. The other end of slot 243 limits the travel of plate 226, to establish the open condition of valve 258.

Member 261 has one short leg 282 and one long leg 283. The legs slide in holes 284 and 285 in body 190, the former being drilled in wall 206 and the latter in wall 207. A hole 286 is formed in the inner end of leg 283 through which stud 234 passes. Wall 205 is recessed to provide a socket 287 for a compression spring 290 which acts outwardly of the central loop 291 of member 261 at a suitable pad 292. The central loop of member 269 includes a right angle bend to permit adequate spacing between the springs. Spring 290 thus holds valve 238 in its closed position, stud 235 being held against one end of slot 223. The other end of slot 223 limits the travel of plate 226 to establish the open condition of valve 238.

The actuating apparatus for valve mechanism, 183, 184, and 185 is made up of components shown separately in FIGS. 10, 11, 12, 13 and 14, and comprising a first cam follower mechanism 300, a second cam follower mechanism 301, and a cam assembly 302.

Follower mechanism 300 is arranged for connection to the outer end of sleeve 135, which is cut to provide a pair of depressions 307 having tapped holes 310. A supporting plate 311 of mechanism 300 has a central opening 312 configured to be received in the depressions 307 in sleeve 135 and to be secured there by screws passing through holes 313 into holes 310. A first cam follower 314 slides radially in a mounting 315 defined by guide blocks 316 and 317 and upper and lower base plates 318 and 319. Members 316–319 are held in assembled relation by means including a pair of screws 321 and a pair of pins 322. Follower 314 has an outwardly enlarged head 323 which is received in a notch 325 in plate 318, and a leaf spring 326 passes outwardly over the follower and inwardly behind pins 322. The leaf spring has curved ends to maintain it in a proper position in mounting 315, and normally urges the follower in a radially inward direction.

Plate 318 is offset at 327 and continues as a lower base plate of a second mounting 330 for a second cam follower 331. Mounting 330 is the same in construction as mounting 315. It will be evident that the angular relation, about axis 73, between piston assembly 123 and cam followers 314 and 331 is fixed, and that all move about axis 73 as a unit.

Follower mechanism 301 is arranged for connection to the outer end of sleeve 115, which is cut to provide a pair of depressions 340 having tapped holes 341. A supporting plate 342 of mechanism 301 has a central opening 343 configured to be received in the depressions 340 in sleeve 115 and be retained there by screws passing through holes 344 and into holes 341. Mechanism 301 is constructed like mechanism 300 previously described, having cam followers 345 and 346 movable radially in mountings 347 and 348. It will be evident that the angular relation, about axis 73, between piston assembly 103 and cam followers 345 and 346 is likewise fixed, and that these members also move about axis 73 as a unit.

Cam assembly 302 comprises a pair of cams 350 and 351 spaced by and integral with a cylindrical body 352 having a set screw 353 for securing it to crank shaft 65. The arrangement is such that when components 300, 301, and 302 are mounted on sleeve 135, sleeve 115 and crank shaft 65 respectively, cam 351 is axially positioned to engage cam followers 314 and 345, and cam 350 is axially positioned to engage cam followers 331 and 346.

FIG. 13 shows cam follower 314 moving past member 260 without actuating it: at this time can 351 is not positioned to actuate follower 314. FIG. 14 shows the configuration of elements necessary to operate member 260: both cam 351 and cam follower 314 must be properly angulated to bring this about. It will be realized that there is also an interval when cam 351 is aligned with member 260, but follower 314 is not present.

Cams 350 and 351 are spaced angularly about axis 73 by 120°, and are of slightly less than 120° in extent. Apertures 180, 181 and 182 are also spaced by 120°, as are followers 314 and 331 and followers 345 and 346. The total extent of piston assemblies 103 and 123 in the toroidal chamber is in each case less than 120 degrees by about the angular extent of one of apertures 180, 181 and 182.

The foregoing arrangement coordinates the operation of the valving mechanism to bring about the desired motor operation. It is the nature of the linkage 160 that two rotations of crank shaft 65 result from one complete rotation of pivot arms 141 and 143, hence the valve mechanism cannot properly be cammed directly from the crank shaft. The interposition of cam followers 314, 331, 345 and 346 ensures that the cam will not operate the valve actuators during every revolution of the crank shaft, but only during intervals appropriate to cause proper motor operation. This will be evident from a careful consideration of FIGS. 5 and 4, remembering that since these views are from opposite ends of the motor, the apparent directions of rotations are opposite Let it be assumed that elbows 217 are connected to a supply of energizing gas, such as steam from a suitable boiler, and that elbows 220 are connected to an exhaust manifold. Then the valves operated by cam 351 are inlet valves, and those operated by cam 350 are outlet valves. Cam follower 314 is aligned with valve mechanism 184, and cam 351 is holding open that inlet valve. Cam follower 331 is aligned with valve mechanism 185, and cam 350 is holding that outlet valve open. Both valves in mechanism 183 are closed. Cam followers 345 and 346 are out of alignment with any valve mechanisms.

In FIG. 3, energizing gas is being supplied at aperture 181, and aperture 182 is free to allow gas to escape: piston assembly 123 is positioned-locked by mechanism presently to be described. As a result, piston assembly 103 is being displaced in a counter-clockwise direction in FIG. 3, causing clockwise movement of pivot arm 143. Pivot arm 141 is locked, and the movement of arm 143 acts on linkage 160 at pivot point 166, FIG. 4 to produce motion which combines pivoting as a unit about axis 73 with modification of the internal angles of the linkage. The result is transmitted to crank pin 147 by links 171 and 172 and causes clockwise rotation of the crank shaft.

The movement of arm 143 is accompanied by counter-clockwise rotation of mechanism 301, and the crank shaft rotation is accompanied by counter-clockwise rotation of cam assembly 302. These motions continue until cams 350 and 351 move out of engagement with followers 314 and 331, allowing the presently open inlet and outlet valves to close. The condition has now been reached shown in FIGS. 15, 16 and 17. Cam follower 346 is now generally aligned with valve mechanism 183 and cam follower 345 is now generally aligned with valve mechanism 185.

Figure 16:
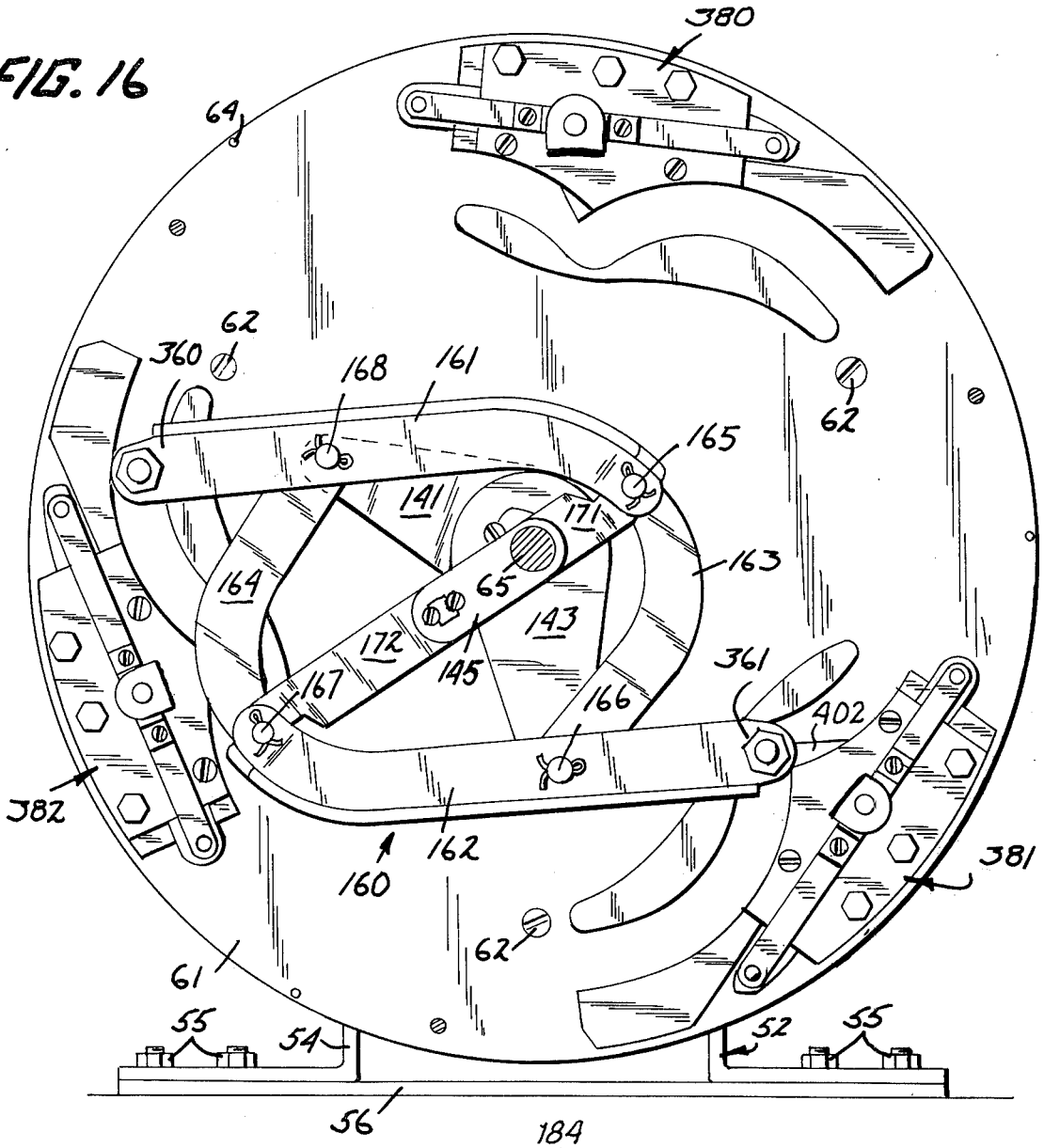
FIG. 16 is a view like FIG. 4 in the second condition of the motor.
Figure 19:
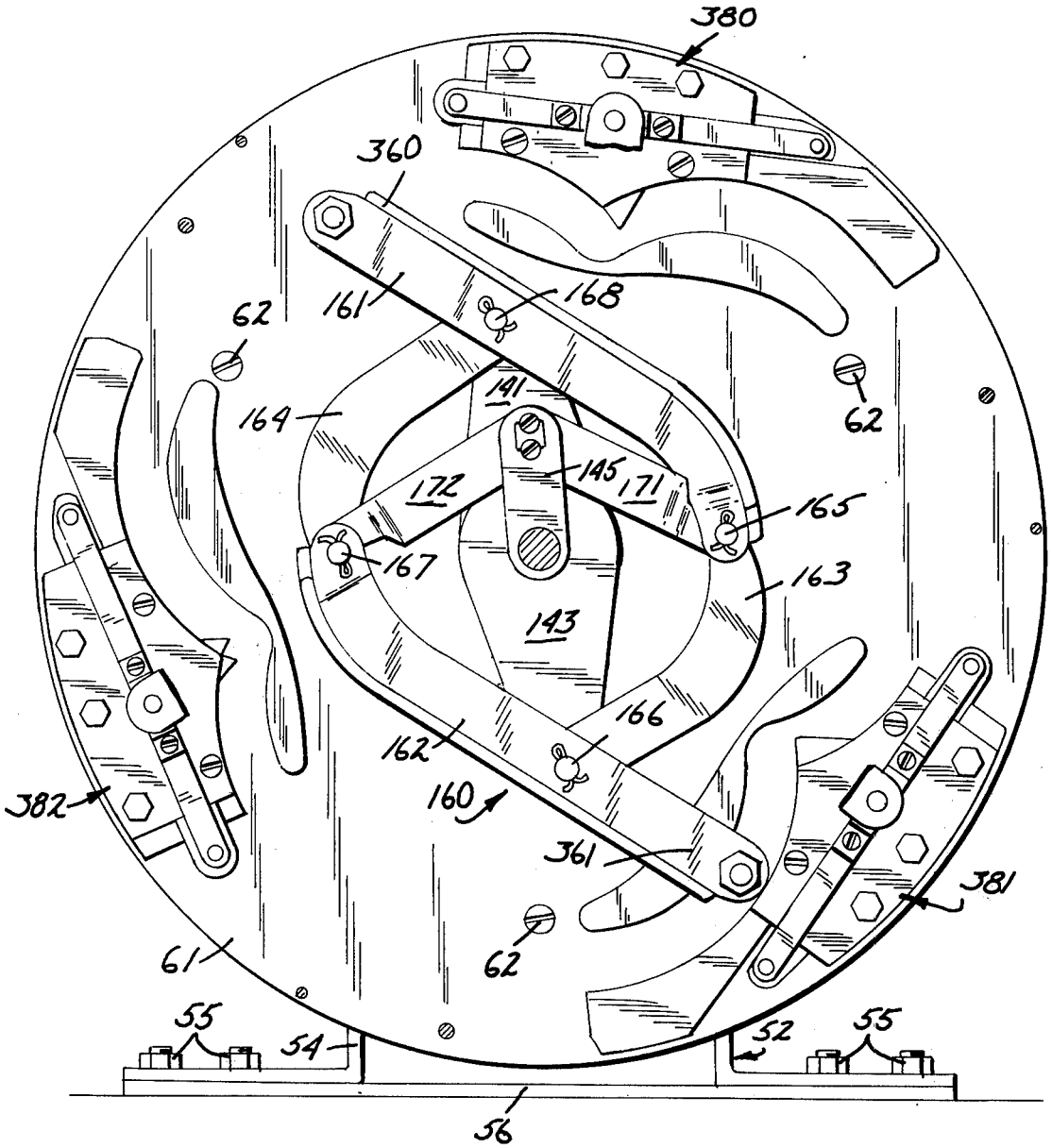
FIG. 19 is a view like FIG. 4 in the third condition of the motor.

While the condition of linkage 160 shown in FIG. 16 is one of "dead-center" with pivot points 165 and 167 on a straight line through crank pin 147, the inertia of flywheel 71 carries the linkage past that point, to where movement of pivot arm 141 accompanying movement of piston assembly 123 can once more act through linkage 160 and links 171 and 172 to drive the crank shaft. The movement of pivot arm 141 also causes movement of mechanism 300, and the condition shown in FIGS. 18–20 is reached. The process continues, the piston assemblies advancing by 120° alternately in the same direction, the crank shaft being driven continuously in one direction, and the valve operation being prepared by mechanisms 300 and 301 and actuated by cam assembly 302.

It has previously been mentioned that locking means are provided to ensure that only one piston assembly is free to move in the desired direction, reverse movement of the other piston being prevented. This arrangement will now be described, referring first to FIG. 4.

Bar 161 has an outward extension 360 beyond pivot point 168, and bar 162 has a similar extension 361 beyond pivot pin 166. Because linkage 160 is symmetrical, points at the ends of extensions 360 and 361 trace the same path about axis 73, which path is shown in broken lines at 362 in FIG. 4. Path 362 is a regular curve having three lobes 363, 364 and 365 intersecting at cusps 366, 367 and 368. A pair of pivot screws 373 are mounted at the ends of bars 161 and 162, as by nuts 374, and support a pair of guide members or rollers 375 and 376, respectively.

Located in the neighborhood of the cusps of path 362 are a plurality of locking mechanisms 380, 381 and 382 shown best in FIGS. 21–25. Since they are identical, only one description will be given in detail. Locking mechanism 380 comprises a fixed abutment 383 projecting from plate 61 and secured thereto in any suitable fashion, as by welding, and a mechanically adjustable abutment 384. These abutments cooperate to define a channel 385 for any roller passing between them, abutment 383 constraining the roller against radially inward movement, and abutment 384 constraining the roller against radially outward movement.

Abutment 384 is defined in part by a solid member 386 fixed to plate 61 in any suitable fashion, as by welding, and in part by a laminate structure 387 partly abutting and partly overlying member 386. The configuration of member 386 is shown partly in dotted lines in FIG. 21; it is of the same thickness as member 383, except for a recess indicated at 388.

Structure 386 comprises a base plate 390, a first guide plate 391 having a lip 392, a first stop member 393, a second guide plate 394, a second stop member 395, a top plate 396, and filler plates 397 and 398. It will be realized that members 385, 390, 391, 392, 297 and 398 may be formed as a single unitary casting, for example, if desired, as can members 394 and 396.

Member 393 is free to slide in an arcuate path defined between members 386 and 391, moving between base plate 390 and overlying laminae including members 394 and 395. Member 395 is free to slide in an arcuate path between member 394 and members 392 and 397, moving between members 393 and 391 on one side, and top plate 396 on the other side. To this end, members 393 and 395 have edges defining concentric circular arcs, and members 385, 391, 392, 394 and 397 are configured to match. Member 395 has a lip 401 which protrudes into channel 385 when member 395 slides to the right in FIG. 23. Similarly, member 393 has a lip 402 which protrudes into channel 385 when member 393 slides to the left in FIG. 23. Total movement of members 393 and 395 is limited at each end by recess 388 and members 397 and 398. Assembly of the laminate structure is simplified by screws 399, which may be inserted as the structure is being assembled, final assembly being accomplished by fasteners 400.

As shown in FIG. 21, a roller 375 or 376 is prevented from moving to the right when extension 401 protrudes into channel 385: it will be appreciated that in the same fashion, movement of a roller to the left is prevented when lip 402 protrudes into channel 385.

Members 393 and 395 are provided with apertures 403 and 404 for receiving the pins 405 and 406 which project from an actuating rod 407. This rod may be actuated to the left or the right by a drive pin 410 projecting from a bracket 411 secured to the rod by suitable fasteners 412. In FIGS. 21–22, rod 407 is shown in its right-hand position. The length of each rod 407 is such that when it in position to cause one of the stop members to protrude fully into channel 385, the other is fully retracted. Each rod is normally in one or the other of its extreme positions; when the rod slides from one extreme position to the other, there is an interval during which both stop members are partially protuberant.

Figure 26:
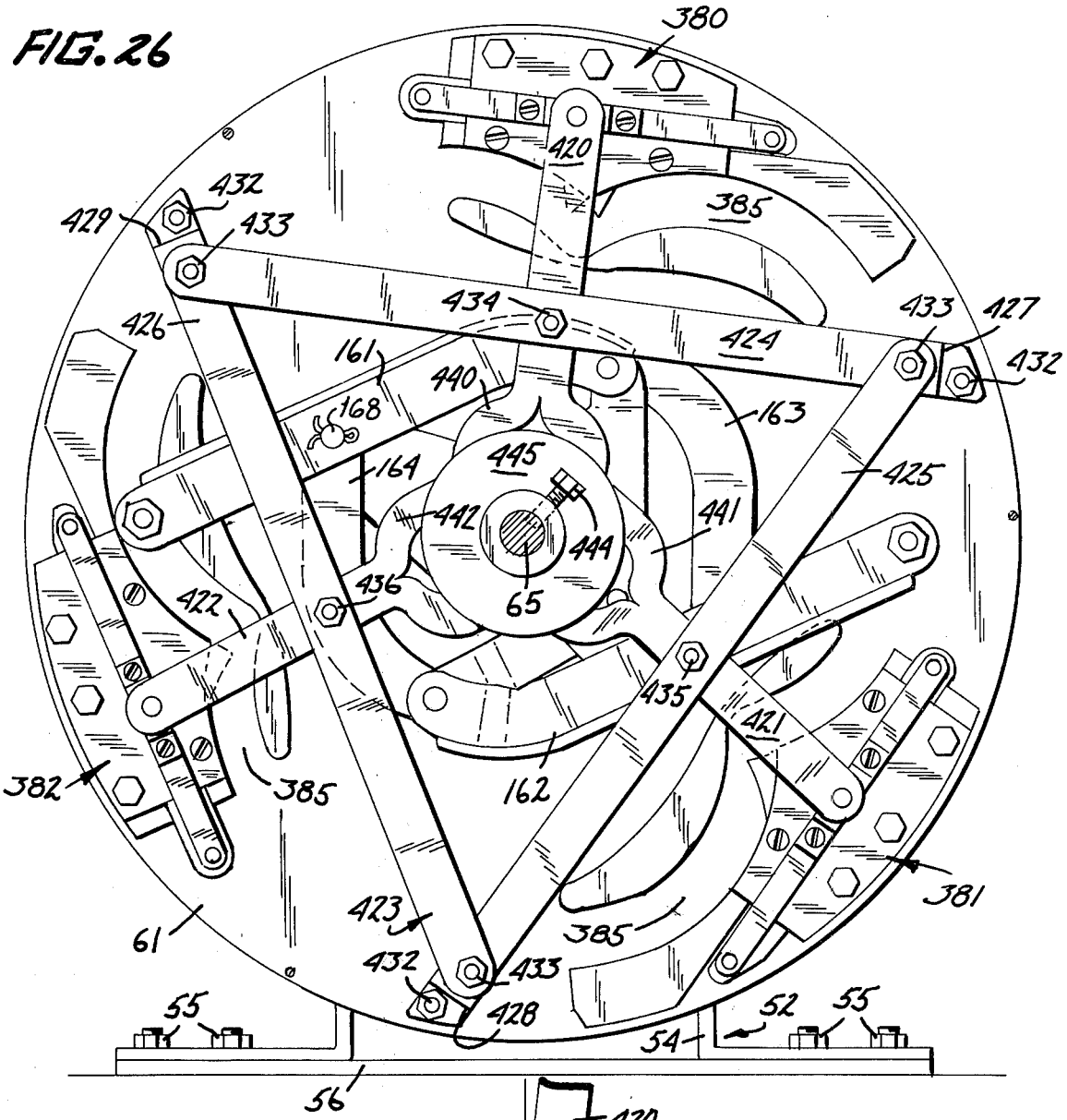
FIG. 26 is an elevational view as seen from left to right of FIG. 1 with the cover removed.

As suggested in FIG. 4, and showed more clearly in FIG. 26, the actuating rods 407 of locking mechanisms 380, 381, and 382 are driven through their pins 410 by a set of arms 420, 421 and 422. A triangular frame 423 is constructed of three bridge members 424, 425 and 426 having offset legs 427, 428 and 429 to space them above the linkage mechanism previously described. The offset end of each member is secured to plate 61, as by fasteners 432. The other ends of the members are mutually supported by the offset ends of other members, as by fasteners 433, to maintain the desired spacing.

Figure 27:
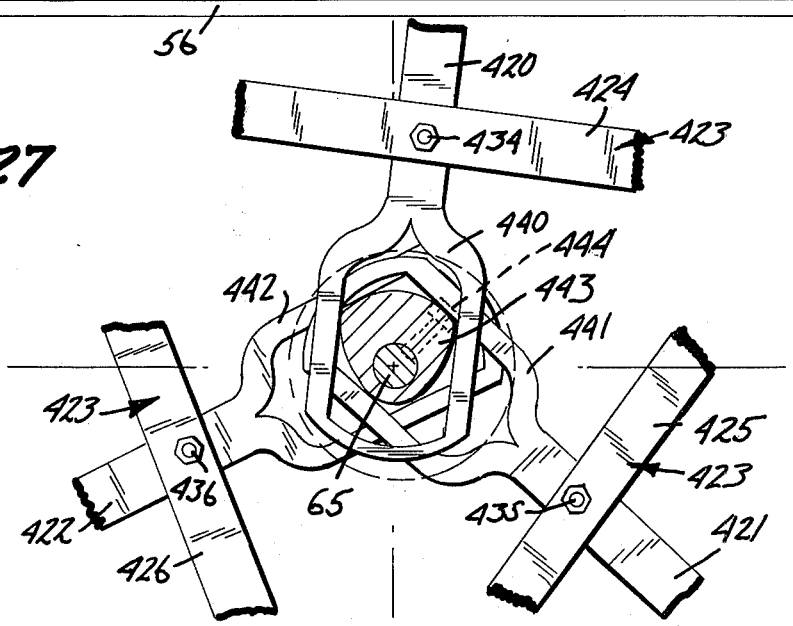
FIG. 27 is a fragmentary detail of FIG. 26 with parts removed for clarity.

Midway along the bridge members there are positioned pivot screws 434, 435 and 436, to which arms 420, 421 and 422, respectively, are pivoted. The inner ends of the arms are formed as stirrups 440, 441 and 442, as shown in more clear detail in FIG. 27. The stirrups circumscribe a cam 443, secured to crankshaft 65 by a fastener 444, so that the rotation of the cam causes separate pivotal movements of the arms about their pivot screws. The angular displacement of the arms due to cam actuation is so small, compared to the distances between the pivot points and the drive pins, that movement of the latter does not depart significantly from straight line motion.

Referring again to FIG. 26, the stirrups are maintained in position by a flange 445 on cam 443.

It will be evident that the operation of cam 443 with each stirrup, for example stirrup 440, is such that arm 420 is maintained displaced in one direction for a substantial portion of the rotation of the crank shaft, is maintained in the opposite direction for a longer interval, and is displaced between these two positions very rapidly. It will also be evident that the cam acts on the stirrups in 120 degrees phase relationship: in the figure, stirrup 440 is in mid-travel, stirrup 441 has just reached maximum clockwise displacement about pin 435, and stirrup 442 is about to leave its maximum counter-clockwise displacement about pivot 436.

The position of cam 443 on crank shaft 65 is coordinated with operation of linkage 160, and when rightly set for any one stirrup is right for all. Further, only the lips 401 of the stop members 395 are used for operation of the motor in one direction, the lips 402 of the stop members 393 functioning only for reverse operation of the motor. Furthermore, two rotations of cam 443 with cam shaft 65 occur for each single rotation of the piston assemblies and four-bar linkage.

Consider first the condition of the motor illustrated in FIGS. 3–5. It has already been explained that the valves are set to cause counter-clockwise movement of piston assembly 103 with accompanying clockwise movement of pivot arm 143. Gas pressure is also being exerted clockwise on piston assembly 123, however, in a sense to cause pivot arm 141 to rotate counter-clockwise in FIG. 4. However, the line of force through pivot point 168 and pivot screw 373 is perpendicular to the surface of abutment 383, so pivot arm 141 is locked and with it piston assembly 123.

Figure 17:
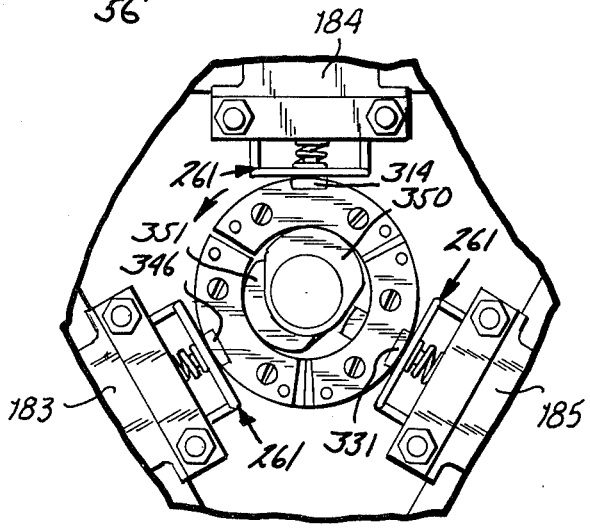
FIG. 17 is a fragmentary detail like FIG. 5 in the second condition of the motor.

Now as arm 143 continues to rotate, bar 161 pivots about pin 168 to move roller 375 through a portion of lobe 363, and bar 162 pivots about pivot 166 as the latter partakes of the linkage motion, so that roller 376 follows a portion of lobe 364. Presently, the situation shown in FIGS. 15–17 is reached. Roller 376 has reached cusp 367 near mechanism 381, and valve operation has taken place which causes the energing gas to now impel arm 141 clockwise and arm 143 counter-clockwise. At this time, however, lip 402 of mechanism 381 has been protruded and prevents arm 143 from rotating counter-clockwise, so the gas pressure results in clockwise motion of arm 141. Bar 162 pivots about pivot 166, and roller 376 bears radially outwardly against the wall of channel 385 of mechanism 381, continuously preventing reverse motion of arm 143. As soon as arm 162 begins to pivot on point 166, roller 376 moves away from lip 402, the function of which has for the present been accomplished. Bar 161 pivots about point 165 as the latter partakes of the rotation of linkage 167, moving roller 375 out of channel 385 of mechanism 382 toward the condition shown in FIGS. 18–20. As roller 375 passes through the cusp adjacent mechanism 380, protrusion of lip 402 therein is briefly necessary: subsequently, lip 402 is needed in mechanism 382 for roller 376, lip 402 in mechanism 381 for roller 375, and so on cyclically. In one complete cycle of operation of the piston assemblies, each of rollers 375 and 376 passes through the channels of all three locking mechanisms, and there is never a time when neither roller is in a locking mechanism, although there are times when both rollers are in locking mechanisms. Protrusions of lips 401 and 402 in the several mechanisms takes place six times, thrice when rollers are in the cusp, and thrice when the cusps are empty: this is an incident to driving cam 443 from the double speed crank shaft.

The reason for having both lips 401 and 402 is to enable operation of the motor to take place in either direction. Lips 401 operate when the linkage 160 moves in the direction opposite to that just described. For example, consider the condition of FIG. 19 with the inlet and outlet connections reversed. Energizing fluid is impelling piston assembly 123 counter-clockwise and piston assembly 103 clockwise in FIG. 18, so that pivot arms 143 and 141 in FIG. 19 are impelled respectively clockwise and counter-clockwise. Arm 143 cannot move clockwise, however, because roller 376 engages member 383 of mechanism 381 in a radially inward direction. Accordingly, arm 141 rotates clockwise bringing roller 375 into the channel 387 of mechanism 380. As the roller passes through cusp 362, lip 401 of means 380 will be protruded to prevent reverse operation of the linkage under the new valve conditions of energizing gas, as the valving shifts, and again the cycle repeats.

From the foregoing it will be evident that I have invented a new and improved rotary engine capable of developing great power because of the steady flow of power to the crank shaft, and because there is no power loss in reversing the direction of motion of pistons and their piston rods.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

What is claimed is:

1. An engine comprising, in combination:

a stationary toroidal chamber having a closed axis, which is circular about an axis of radial symmetry, and having a circular cross section in any plane passing through said axis of symmetry;

first and second double-ended piston assemblies slidable without limit in said chamber for independent revolution about said axis of symmetry;

a pair of concentric pivot arms connected severally to said piston assemblies for rotary movement therewith about said xis of symmetry;

a crank shaft concentric with said axis of symmetry;

a rotatable linkage, for connecting said pivot arms in bidirection driving relation to said crank shaft, comprising four arms interlinked at pivots defining a quadrilateral, means connecting a first opposite pair of said pivots respectively to said pivot arms, and means connecting the second opposite pair of said pivots to said crank shaft;

means coacting with opposite arms only of said linkage to prevent movement of said piston assemblies in a first direction;

a set of three apertures communicating with said chamber at locations equally spaced about said axis of symmetry;

normally closed valve means communicating severally with said apertures for controlling both the ingress and the egress of energizing fluid thereat; and valve actuating means connected individually to said piston assemblies for rotary motion therewith about said axis of symmetry to actuate said valve means in a predetermined sequence, whereby to enable said fluid to cause alternate arcuate movements of said piston assemblies in a second, opposite direction about said axis of symmetry, and produce rotation of said crank shaft.

2. An engine comprising, in combination:

a toroidal chamber having a closed axis, which is circular about an axis of radial symmetry, and having a circular cross section in any plane passing through said axis of symmetry;

first and second double-ended piston assemblies slidable without limit in said chamber for independnet revolution about said axis of symmetry;

a pair of concentric pivot arms connected severally to said piston assemblies for rotary movement therewith about said axis of symmetry;

a crank shaft concentric with said axis of symmetry;

a rotatable linkage, for connecting said pivot arms in bidirectional driving relation to said crank shaft, comprising four arms interlinked at pivots defining a quadrilateral, means connecting a first opposite pair of said pivots respectively to said pivot arms, and means connecting the second opposite pair of said pivots to said crank shaft;

means coacting with opposite arms only of said linkage to prevent movement of said piston assemblies in a first direction;

a set of three aperture communicating with said chamber at locations equally spaced about said axis of symmetry; and valve means actuated severally in accordance with the movements of said piston assemblies, for controlling the ingress and egress of energizing fluid through said apertures.

* * * * *

UNITED STATES PATENT AND TRADEMARK OFFICE

CERTIFICATE OF CORRECTION

PATENT NO. : 4,035,111

DATED : July 18, 1977

INVENTOR(S) : Peter J. Cronen, Sr.

It is certified that error appears in the above-identified patent and that said Letters Patent are hereby corrected as shown below:

Column 1, line 32, "axis" should be --annexed--.

Column 1, line 41, "drawings, bidirectional" should be --drawings--.

Column 2, lines 22 and 23, "to a view in larger" should be --to a larger--.

Column 2, line 24, "FIG. 2" should be --FIG. 22--.

Column 2, line 24, "is a view in plan view of" should be --is a plan view of--.

Column 2, line 26, "is a section" should be --is a view in section--.

Column 2, line 28, "is a section" should be --is a view in section--.

Column 2, line 30, "is a section" should be --is a view in section--.

Column 2, line 40, "bloc" should be --block--.

Column 5, lines 42-44, the sentence beginning on line 42 was canceled by the Amendment filed October 4, 1976 and should not have been printed.

Column 5, line 59, "mechanism" should be --mechanisms--.

UNITED STATES PATENT AND TRADEMARK OFFICE

CERTIFICATE OF CORRECTION

PATENT NO. : 4,035,111

DATED : July 18, 1977

INVENTOR(S) : Peter J. Cronen, Sr.

It is certified that error appears in the above-identified patent and that said Letters Patent are hereby corrected as shown below:

Column 8, line 30, "297" should be --397--.

Column 8, line 65, "it in position" should be --it is in position--.

Column 11, line 11, "xis" should be --axis--.

Column 11, line 14, "bidirection" should be --bidirectional--.

Column 12, line 10, "independnet" should be --independent--.

Column 12, line 27, "aperture" should be --apertures--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*